United States Patent [19]

Kudlacek

[11] Patent Number: 4,757,614

[45] Date of Patent: Jul. 19, 1988

[54] ARCHERY BOW SIGHT

[76] Inventor: Donald S. Kudlacek, 3412 Oak St., Longview, Wash. 98632

[21] Appl. No.: 54,130

[22] Filed: May 22, 1987

Related U.S. Application Data

[63] Continuation of Ser. No. 877,596, Jun. 23, 1986, abandoned.

[51] Int. Cl.[4] ..... F41G 1/00

[52] U.S. Cl. ..... 33/265; 124/87

[58] Field of Search ..... 33/265; 124/87, 88, 124/24 R

[56] References Cited

U.S. PATENT DOCUMENTS

| | | | |
|---|---|---|---|
| 3,574,944 | 4/1971 | Reynolds | 33/265 |
| 3,696,517 | 10/1972 | Larson | 33/265 |
| 3,787,984 | 1/1974 | Bear et al. | 33/265 |
| 4,305,208 | 12/1981 | Larson | 33/265 |
| 4,535,747 | 8/1985 | Kudlacek | 33/265 |
| 4,584,777 | 4/1986 | Saunders | 33/265 |
| 4,625,421 | 12/1986 | Strauss | 33/265 |

*Primary Examiner*—William A. Cuchlinski, Jr.
*Assistant Examiner*—Patrick R. Scanlon
*Attorney, Agent, or Firm*—Olson and Olson

[57] ABSTRACT

An archery bow sight includes a plate arranged for removable attachment to the handle portion of an archery bow and supporting a longitudinally extendable mounting arm which mounts at its forward end a horizontally extending support to which a vertically elongated sight bar is mounted for horizontal windage adjustment. The sight bar mounts a plurality of sight pin blocks by means of interconnecting dovetail components, the blocks extending transversely across the sight bar for adjustment along the length of the sight bar. An elongated threaded sight pin member extends adjustably through a threaded bore in each block in the transverse direction of the sight bar, and a slot intercepts the dovetail component and sight pin bore in the block. A clamp screw in the block extends across the slot and operates upon rotation in one direction to clamp the block to the sight bar and the sight pin to the block.

3 Claims, 1 Drawing Sheet

ARCHERY BOW SIGHT

This application is a continuation of application Ser. No. 877,596, filed June 23, 1986 and now abandoned.

BACKGROUND OF THE INVENTION

This invention relates to sights for archery bows, and more particularly to a multiple sight pin archery bowsight for use in both tournament shooting and bow hunting.

Multiple pin-type sighting devices for archery bows are known in the art, and fall in two basic categories: sights utilizing a plurality of sight pins arranged in a single longitudinally extending adjustment slot in a mounting plate, and sights utilizing a plurality of sight pins arranged in a pair of parallel, longitudinally extending adjustment slots in a mounting plate.

In the first case, the sight pins are arranged to extend through a single adjustment slot, whereby the sight pins are disposed in a single plane. However, such configurations severely restrict the adjustment of adjacent pins in that the pins cannot be moved close enough together to allow for fine settings of relatively small changes in yardages.

In the second case, the plurality of pins are arranged to extend through a pair of parallel extending slots. However, such a configuration provides sighting pins arranged in two rows each at a different distance from the eye of the archer. In this respect, while closer adjustment of adjacent pins may be made, the varying distance of each adjacent pin from the archer's eye reduces the accuracy of fine aiming on a target.

Also, in both categories of prior multiple pin type bowsights described above, no provision is made for individual adjustment of each sight pin for windage conditions and differing shooting characteristics. While gross adjustments of the entire bank of sight pins jointly may be made with some sights of the prior art, the constructions of the prior art bowsights do not afford each individual sighting pin separate adjustment perpendicular to the plane of its supporting slot.

My earlier U.S. Pat. No. 4,535,747 overcomes the foregoing disadvantages and limitations by mounting a plurality of pins in a pair of vertical guide slots for independent adjustment of each sight pin in directions extending both parallel to and perpendicular to said guide slots. Although the arrangement is very effective and efficient, it also is a somewhat complex and costly construction.

SUMMARY OF THE INVENTION

In its basic concept, this invention provides an archery bowsight in which a plurality of sight pins are mounted for transverse horizontal adjustment on individual clamp blocks which are only slightly wider than the sight pins and are supported on an elongated vertical sight bar for independent vertical adjustment, each sight pin being secured in its adjustment on the clamp block automatically as the clamp block is clamped to the sight bar.

It is by virtue of the foregoing basic concept that the principle objective of this invention is achieved; namely, to overcome the disadvantages and limitations of archery bowsights of the prior art with a more simplified and less costly construction than my earlier U.S. Pat. No. 4,535,747.

Another objective of this invention is to provide an archery bowsight of the class described in which each clamp block is slightly flexible in the direction of the sight pin, whereby its clamping to the sight bar is accompanied by frictional clamping of the sight pin in the selected position of adjustment.

Yet another object of this invention is the provision of an archery bowsight of the class described which is arranged with parts that are easily reversible in order that the sight may be arranged for use by either a right or left handed archer.

A further object of this invention is the provision of an archery bowsight of the class described which may mount a removable pin guard frame arranged to protect the sight pins from damage and which pin guard may also mount an adjustable crosshair sight wire for use in bow hunting.

A still further objective is the provision of an archery bowsight of the class described which is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
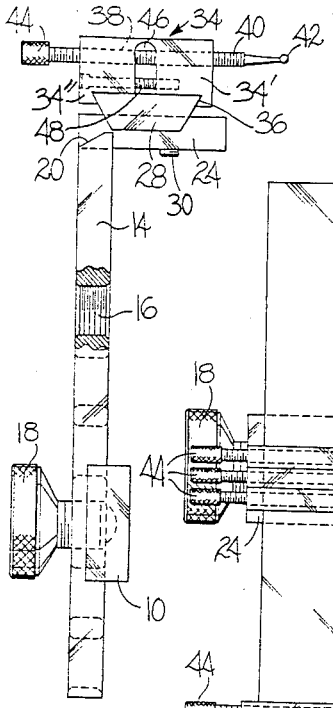
FIG. 1 is a plan view of an archery bowsight embodying the features of this invention.
Figure 2:
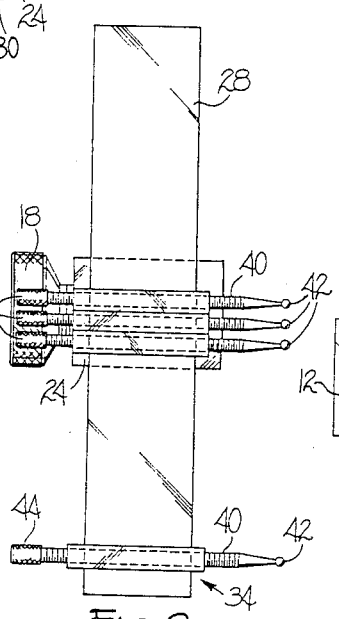
FIG. 2 is a front elevation of the archery bowsight as viewed from the top in FIG. 1.
Figure 3:
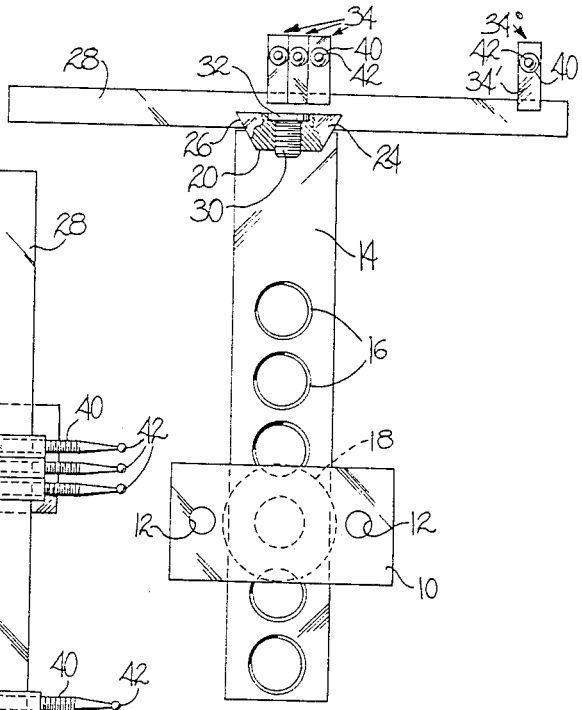
FIG. 3 is a side elevation of the archery bowsight as viewed from the right in FIG. 1.
Figure 4:
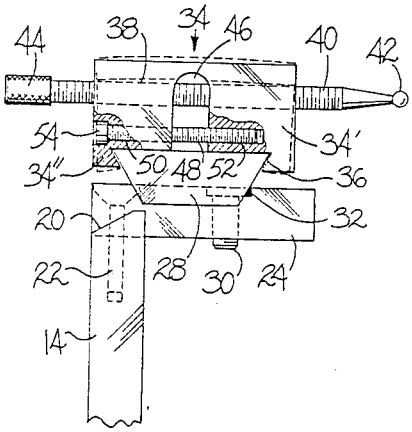
FIG. 4 is a fragmentary plan view, on an enlarged scale, of the sight pin assembly of FIG. 1, parts being broken away to disclose internal structural details.

The bowsight of this invention includes a bow handle mounting plate 10 arranged to be anchored, as by screws (not shown) extending through openings 12 in the plate, in a desired position on a bow handle. The mounting plate includes a centrally located dovetail slot arranged to slidably receive an elongated mounting arm 14 having a corresponding dovetail cross section.

The mounting arm includes a plurality of longitudinally spaced, threaded bores 16 which, in cooperation with a set screw 18, provide means for releasably securing the arm to the mounting plate in various positions of longitudinal extension.

The forward end of the mounting arm is provided with a recess 20 to receive and mount, as by a screw 22, a support bracket 24 having the same dovetail cross section as the mounting arm. The support bracket extends perpendicular to the mounting arm, as illustrated. The support bracket is provided with a dovetail cross section for slidable reception in a transverse dovetail slot 26 intermediate the ends of an elongated sight bar 28. The assembly of mounting plate 10, mounting arm 14 and support bracket 24 forms a base for mounting the sight bar.

In the preferred embodiment illustrated, the dovetail cross section of the sight bar, support bracket and mounting arm are the same, whereby the major components of the bowsight are provided most economically from a common extrusion.

The dovetail interconnection of the support bracket and sight bar affords limited adjustment of the sight bar along the support bracket to provide windage adjustment. The position of adjustment of the sight bar along the support bracket is secured releasably by a clamp screw 30 provided with an Allen socket in its outer end. In the preferred embodiment illustrated, a plastic pad 32 is interposed between the clamp screw and the confronting undersurface of the sight bar to improve the clamping efficiency while preventing marring of the undersurface of the sight bar.

The sight bar mounts a plurality of sight-supporting clamp blocks 34. In the embodiment illustrated in FIGS. 1-4, each block is provided with a dovetail groove 36 which extends transversely through its bottom side, matching the dovetail cross section of the sight bar to provide a sliding fit. A threaded bore 38 extends longitudinally through the upper portion of the sight block, perpendicular to the dovetail groove 36, for threaded reception of a sight element. In the embodiment illustrated, the sight element is comprised of an elongated threaded rod 40 mounting a sight bead 42 on its forward end and a knurled adjustment knob 44 on its rearward end.

It is an important feature of this invention that the sight block 34 is only slightly wider than the diameter of the sight pin rod 40, whereby a plurality of sights may be brought closely together on the sight bar by abutting the blocks one against another. This close spacing is similar to the close spacing provided by the spaced slots of my earlier construction described in U.S. Pat. No. 4,535,747.

A central slot 46 extends upwardly from the dovetail groove 36 in each sight block, and it intercepts the threaded bore 38, terminating slightly below the top side of the block. This slot divides the sight block into fore-and-aft sections 34' and 34", respectively, which, because of the thin web section between them and above the slot, are moveable resiliently toward and away from each other.

A threaded clamp screw 48 extends through an unthreaded bore 50 in the aft section 34", across the central slot 46 and into a threaded bore 52 in the fore section 34'. A head 54 on the clamp screw contains an Allen socket for rotating the screw.

With one or more sight blocks 34 mounted loosely on the sight bar 28, each sight element rod 40 may be rotated in the threaded bore 38 to adjust the sight bead 42 to the desired lateral position. Each sight block can then be adjusted along the length of the sight bar to the desired vertical position, and then the clamp screw 48 is rotated to draw the fore and aft sections of the sight block together into clamping engagement with the sight bar. This moves the sections of the threaded bore 38 on opposite sides of the central slot 46 slightly out of axial alignment and thereby causes them to apply clamping pressure to the clamping sight rod 40. This clamping pressure thereby prevents subsequent inadvertent rotation of the sight rod and consequent misadjustment of the sight bead.

Figure 5:
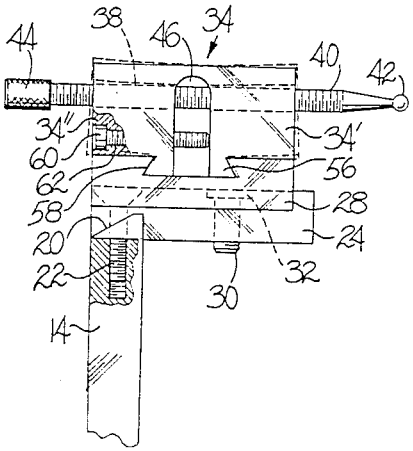
FIG. 5 is a fragmentary plan view, similar to FIG. 4, of a modified form of sight pin assembly.

In the embodiment illustrated in FIG. 5, each sight block 34 is provided with a bottom section 56 of dovetail cross section and the sight bar 28 is provided with a longitudinally extending matching dovetail groove 58. The clamp screw 60 is threaded into a threaded bore 62 in the aft section 34" and it extends across the central slot 46 into abutment with the confronting surface of the fore section 34'.

By turning the clamp screw 60 in the direction to move it toward said confronting surface, the fore and aft sections are moved apart, bringing the dovetail sections 56 into clamping engagement with the dovetail groove 58 in the sight bar. This moves the sections of threaded bore 38 slightly out of axial alignment and causes them to apply clamping pressure to the threaded sight pin rod 40, as in the embodiment previously described.

It will be appreciated that the pin guard described in my earlier U.S. Pat. No. 4,535,747 may be attached to the opposite ends of sight bar 28 to extend across and protect the sight pins from damage during bow hunting. The pin guard also may support the crosshair wire in the manner and for the same purpose as described in my earlier patent.

The bow sight shown in the drawings is configured for use by a left handed archer. For use by a right handed archer, the bowsight would be mounted on the opposite side of a bow handle and the assembly illustrated in FIG. 1 would simply be rotated 180° about the longitudinal axis of the mounting arm 14.

As in my earlier bowsight construction, the bowsight of this invention is arranged to accommodate accurate aiming on targets by archers that habitually hold a bow in a tilted position, i.e. extending obliquely relative to the ground. In such event, the sight pins may be adjusted so that the sight beads 42 of the pins are aligned in a vertical plane, even though the bow is held in a tilted position. Moreover, with the pin guard and crosshair wire of my earlier patent mounted on the sight bar, the crosshair wire may be adjusted at each end to move the wire into alignment with the plurality of sight beads.

It will be apparent to those skilled in the art that various changes may be made in the size, shape, type, number and arrangement of parts described hereinbefore without departing from the spirit of this invention and the scope of the appended claims.

Having now described my invention and the manner in which it may be used, I claim:

1. An archery bowsight, comprising:

(a) a base configured for mounting to an archery bow handle, (b) an elongated sight bar member mounted on the base for disposition in a substantially vertical plane, (c) a plurality of sight pin mounting members each comprising a block arranged to extend transversely across the sight bar member, dovetail interconnecting means on the block and the sight bar member, and a slot in the block intermediate the ends of the block intercepting the dovetail interconnecting means therein, for adjustment of the block along the length of said sight bar member, (d) a plurality of elongated threaded sight pins, one of said sight pins being mounted on each block, the sight pin extending across the slot in the block and through axially aligned threaded bores in the block on opposite sides of said slot for adjustable movement transversely of the longitudinal dimension of the sight bar member, and (e) clamp means on each block for releasably clamping the block to the sight bar member in desired position of longitudinal adjustment, (f) the clamp means including a clamp screw in the block spaced from and independent of the sight pin and extending across said slot and operable upon rotation in one direction to move the block sections on opposite sides of the slot simultaneously into clamping engagement with the sight bar member and to move the threaded bores in said block sections out of axial alignment and into clamping engagement with the portions of the sight pin in said threaded bores to prevent rotation of the sight pin.

2. The archery bowsight of claim 1 wherein the clamp screw extends through an unthreaded bore in one section of the block and across the slot in the block and engages a threaded bore in the other section of the block, the clamp screw having an enlarged head for engaging the outer surface of said one section of the block, whereby rotating the clamp screw in one direction moves the block section toward each other into releasable clamping engagement with the sight bar member.

3. The archery bowsight of claim 1 wherein the clamp screw extends through a threaded bore in one section of the block and across the slot in the block and engages the confronting surface of the other section of the block, whereby rotating the clamp screw in one direction moves the block sections away from each other into releasable clamping engagement with the sight bar member.

* * * * *